US006015125A

United States Patent [19]

Fischer

[11] Patent Number: 6,015,125

[45] Date of Patent: Jan. 18, 2000

[54] TOILET PAPER HOLDER WITH WALL MOUNT

[76] Inventor: Larry D. Fischer, 22609 28th Ave. S., Des Moines, Wash. 98198

[21] Appl. No.: 09/154,548

[22] Filed: Sep. 16, 1998

Related U.S. Application Data

[63] Continuation-in-part of application No. 08/821,866, Mar. 21, 1997, abandoned.

[51] Int. Cl.[7] ..... G12B 9/00; B65H 16/02

[52] U.S. Cl. ..... 248/231.9; 248/27.1; 242/595; 242/596.8; 242/598.6; 312/34.24

[58] Field of Search ..... 248/231.9, 27.1 XE, 248/223.41; 242/598.6, 596.8, 595 XE, 596.3; 312/34.24; D6/523

[56] References Cited

U.S. PATENT DOCUMENTS

| | | | |
|---|---|---|---|
| D. 51,165 | 8/1917 | Baker | D6/523 |
| D. 156,498 | 12/1949 | Fomusa et al. | D6/523 |
| 1,436,990 | 11/1922 | Lillibridge | 312/34.24 |
| 1,745,771 | 2/1930 | Sherwood | 242/595 |
| 2,470,030 | 5/1949 | Habuda | 242/596.3 |
| 2,499,815 | 3/1950 | Carlin | 242/596.3 |
| 2,604,285 | 7/1952 | Knoch | 248/27.1 |
| 2,767,945 | 10/1956 | Bragg | 248/77.1 |
| 2,932,463 | 4/1960 | Mau | 242/564.5 |
| 3,037,718 | 6/1962 | Pettit | 242/598.3 |
| 3,239,295 | 3/1966 | Simon | 312/34.24 |
| 3,494,518 | 2/1970 | Goss | 225/34 |
| 3,729,145 | 4/1973 | Koo et al. | 242/596.5 |
| 3,759,473 | 9/1973 | Sosaya | 248/27.1 |
| 4,114,824 | 9/1978 | Danielak | 242/598.5 |
| 4,354,643 | 10/1982 | Kenner | 242/598.5 |
| 4,564,148 | 1/1986 | Wentworth | 242/560.3 |
| 4,721,264 | 1/1988 | Muscarello | 242/598.6 |
| 5,029,767 | 7/1991 | Poole | 242/596.8 |
| 5,255,800 | 10/1993 | Kelly | 211/89.01 |
| 5,649,676 | 7/1997 | Lord | 242/595 |
| 5,697,576 | 12/1997 | Bloch et al. | 242/596.8 |
| 5,697,577 | 12/1997 | Ogden | 242/598.6 |

*Primary Examiner*—Ramon O. Ramirez
*Assistant Examiner*—Anita M. King

[57] ABSTRACT

A paper roll holder comprises a back wall, a concave bottom, a pair of side walls, and a front wall having an upper edge. The back wall, concave bottom, pair of side walls and front wall form a cavity for holding the paper roll. The cavity has sufficient depth for a horizontal plane taken at the upper edge of the front wall to substantially intersect the longitudinal axis of the paper roll in the cavity to brace the paper roll upon separation of sheets of paper from the paper roll. The upper edge of the front wall provides a contact surface for supporting and separating perforated sheets from the paper roll.

4 Claims, 4 Drawing Sheets

TOILET PAPER HOLDER WITH WALL MOUNT

This application is a continuation-in-part of prior application Ser. No. 08/821,866, filed Mar. 21, 1997, now abandoned priority from the filing date of which is hereby claimed under 35 U.S.C. § 120.

FIELD OF THE INVENTION

The invention pertains to holders for paper rolls or the like, and more specifically pertains to spindle-less holders for toilet paper rolls and wall mounts therefore, wherein screws, nuts, and bolts are not needed for attachment of the toilet paper holder in a wall opening.

BACKGROUND OF THE INVENTION

Toilet paper roll dispensers generally known in the art, for the most part, employ a center mounted spindle that is most preferably spring-loaded into the toilet paper holder and around which is secured the toilet paper roll through its center hole for rotation of the toilet paper roll to dispense perforated sheets of toilet paper. The use of a spring-biased spindle makes toilet paper roll changing difficult and unwieldy for persons having impaired motor dexterity. Examples of toilet paper roll holders of the above type include U.S. Pat. No. 2,470,030, issued to Habuda, which discloses a toilet paper dispensing apparatus in which the paper roll may be removably supported for rotation for dispensing in a housing by a pair of relatively shallow bosses, each projecting from the end of substantially L-shaped arms and movable through openings in the end walls of the housing. The other ends of the arms are pivoted on the outside of the housing. The bosses normally remain in a position in which they enter a short distance into the hollow core of the roll of paper, but by swinging the arms around pivots, the bosses may be retracted into a position where they are clear of the paper roll, so that the core may be dropped out and a new roll of paper inserted between the bosses. Retraction of the bosses is accomplished by a pushbutton, which projects through the flange of the housing, and which is an extension of a rod which is slidable in a mounting formed by the flange and a lug projecting from the housing. The rod is provided with an enlarged portion, or abutment. A coiled spring, disposed around the rod and tensioned between the abutment and a lug, normally maintains the pushbutton in the outward position. The rod is also provided with a cam slot, and the end of each arm adjacent its pivot is provided with a cam projection which enters the cam slot. The arms remain normally in the position with the bosses projecting into the interior of the housing. When it is desired to install a roll of paper in the holder, the button is pressed, which causes the rod to move inwardly of the holder, whereby the cam slot cams the cam projections of the arms downwardly, causing the arms to pivot about the pivots and swing the bosses outwardly of the housing. Thus, when the roll of paper is inserted into the housing with the hollow core in register with the bosses as soon as pressure on the button is released the arms swing downwardly under the influence of the spring. The bosses then enter a short distance into the core of the paper roll whereby the roll is securely retained within the housing, but is free to revolve on the bosses whenever the web of paper is drawn off the roll.

U.S. Pat. No. 2,932,463, issued to Mau teaches a roll paper dispenser comprising a main supporting housing having a rear wall, top wall, bottom wall and forwardly extending side walls. In addition, a front panel has an enlarged opening. The side walls are provided with opposed bearing seats. One seat has an opening extendible completely through the seat whereby a rotatable shaft is received into the seats with the shaft at one end extending through one seat and exterior of the housing. A roller of rubber, or any other friction or suitable material, is mounted on the end of the shaft and is arranged to be in rolling engagement with the knurled circumferential surface of a disk wheel. A second roller of rubber or other suitable material is mounted on the shaft midway between the side walls. Outward movement of the shaft through the seat is prevented by a suitable restraining member on the shaft that abuts against the inside surface of the side wall. A bracket member having an outwardly extending portion is secured through the outwardly extending portion to the exterior of a side wall and above and to the side of the roller. A bracket has a U-shaped base with the outside of one of the sides extending a substantial distance downwardly and parallel to a side wall. This bracket side is apertured adjacent its free end to mount a pin for retaining the disc wheel. The front panel is slotted to permit extension of a portion of the disc wheel through it and accessible to manipulation on the part of the operator. Secured to each side wall adjacent the bottom wall and in the front portion thereof are cover holding brackets, each provided with a recessed portion. Mounted in each bracket is a pin, the free ends of which extend toward each other. These pins are arranged to mount a splitter tongue under spring tension by a coil encircling the pins. A longitudinal bracket member together with swingable spaced arms are mounted on the pins. A counterweight is mounted on the longitudinal bracket member and used to swing the arms into the dispenser. The free ends of the arms have roll holding elements which extend inwardly at right angles to the arms. These roll holding elements are spaced sufficiently apart to receive each end of a squared core which frictionally engages the center opening of the roll. These arms are also arranged so that their free ends may swing away from each other to readily receive the core and are also mounted at their other ends under spring tension whereby upon engagement with the core, the roll holding elements grip the core under normal spring tension. The arms may be swung outwardly and the roll of paper placed between the roll holding elements. The roll is always in contact with the rubber roller and rotative action of the disc wheel will unreel the paper because of engagement between the wheel and the rubber roller.

U.S. Pat. No. 3,239,295, issued to Simon, teaches a storage and dispensing unit for toilet paper including a tissue holder unit that engages forwardly-extending wall portions forming a seat in a storage cabinet. When seated, the tissue holder unit is resiliently held by detents which cooperate with and engage corresponding male detent members formed in a resilient attachment or backing plate secured to the rear or inner side of the tissue holder unit. The backing plate member is unitarily formed of resilient metal and is shaped in a semi-cylindrical form to be congruent with the back of the tissue holding recess of the tissue holder unit. The external portion of the tissue holder has fixed thereto a pair of arms by means of screws. These arms extend outwardly into the room, and are axially recessed to form seats to receive rotatably the ends of a pair of telescoping central tubes. The telescoping central tubes are of conventional form, with a compression spring therewithin which exerts axial pressure outwardly against the ends to maintain the tube in its recesses. Normally these telescoping tubes are pressed into their seats with sufficient spring pressure so that they are securedly held therein and do not themselves rotate readily. Rotation of the toilet paper roll is permitted by the large diameter of the center core of the toilet paper roll in relation to the telescoping tubes. When it is desired to insert a new roll of toilet paper, one of the tubes may be reduced in length by telescoping one end over the other against the pressure of the internal compression spring and removed from the recess. When a new roll has been placed in the tube, the ends are inserted again into the recesses against the pressure of the internal spring and permitted to snap outwardly into place.

U.S. Pat. No. 2,499,815, issued to Carlin, discloses a toilet paper holder having a curved back portion, semi-cylindrical sides, and a surrounding flange. The flange has, in two of the opposite sides, vertical slits. Lugs are inserted through the slits, the lugs being made of a springy steel. Each of the lugs comprises a substantially rectangular side portion which is formed with offsets. Thus, the length of the side portion is greater than the length of the slit, thereby assuring that the lugs remain in the proper position. The upper portions of the lugs are formed with members that project towards each other and are adapted to engage the tube on which a roll of toilet paper is wound. These projecting members are made of one piece, with the lugs.

While some spindle-less toilet paper dispensers do exist, they generally require the presence of a slot or slit through which the toilet paper sheets must first be guided prior to use. Additionally, during use, the toilet paper sheets may become disengaged from the slot or slit, thus requiring re-threading. Two examples of spindle-less toilet paper holders are U.S. Pat. No. 1,436,990, issued to Lillibridge, and U.S. Pat. No. D156,498, issued to Fomusa.

A need thus exists for a toilet paper holder lacking a rotatable, or otherwise movable, spring-biased spindle which is mechanically complex and subject to breakdown and that lacks a slit through which the toilet paper sheets are threaded. This threading is often difficult to achieve and often results in undesired disengagement of the toilet paper sheets from the slot during use. It is further desirable to mount the toilet paper holder to a wall opening in dry wall or like sheet-like wall material without the need for screws, bolts and nuts, or the like.

SUMMARY OF THE INVENTION

The invention provides a spindle-free toilet roll holder for attachment, without need for fasteners, into an opening in a sheet-like wall having a specified thickness. The holder includes a back wall in the shape of a half-ovoid with a wider portion of the half-ovoid forming a base portion of the back wall. The holder includes a front wall, of lower height than the back wall, which is formed by forwardly and upwardly extending the curved base portion of the back wall to terminate in a rounded, immobile upper lip. A cavity is formed in the base portion of the holder, by a pair of side walls, which span the spaces between the back and front walls. The cavity is shaped like the larger end portion of a hen's egg in cross section and is sized for holding a roll of toilet paper, and lacks a spindle for insertion into an axial cavity of a roll of toilet paper. The cavity is accessible over the upper lip of the front wall for inserting a roll of toilet paper therein.

The holder also includes a mount, for mounting the holder to a hole of specified dimensions, in a wall. The mount includes a vertical frame that surrounds the toilet paper holder such that a frontal face of the frame forms the upper frontal edges of the side walls, and extends downward around outside surfaces of the base portion of the toilet paper holders. Outer edges of the frame extend beyond outside surfaces of the side walls, back wall and base portion. An upper, outer clip wall extends laterally across the upper outer surface of the back wall, and is angled toward an adjacent rear surface of the frame to form a slot between the frame and the clip wall for clipping onto a wall of specified thickness. Likewise, a lower outer clip wall extends laterally across the outer surface of the base portion of the toilet paper holder, and is angled towards an adjacent rear surface of the frame to form a slot sized for clipping onto the wall.

Thus, when a roll of toilet paper having perforated sheets is inserted into the cavity, it is able to rotate freely in the cavity as paper is withdrawn from the roll. Sheets of paper may be separated at perforations from the roll in the vicinity of the upper lip of the front wall by pulling on the sheets, without pulling the roll out of the cavity, or removing the holder from its position in the wall.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
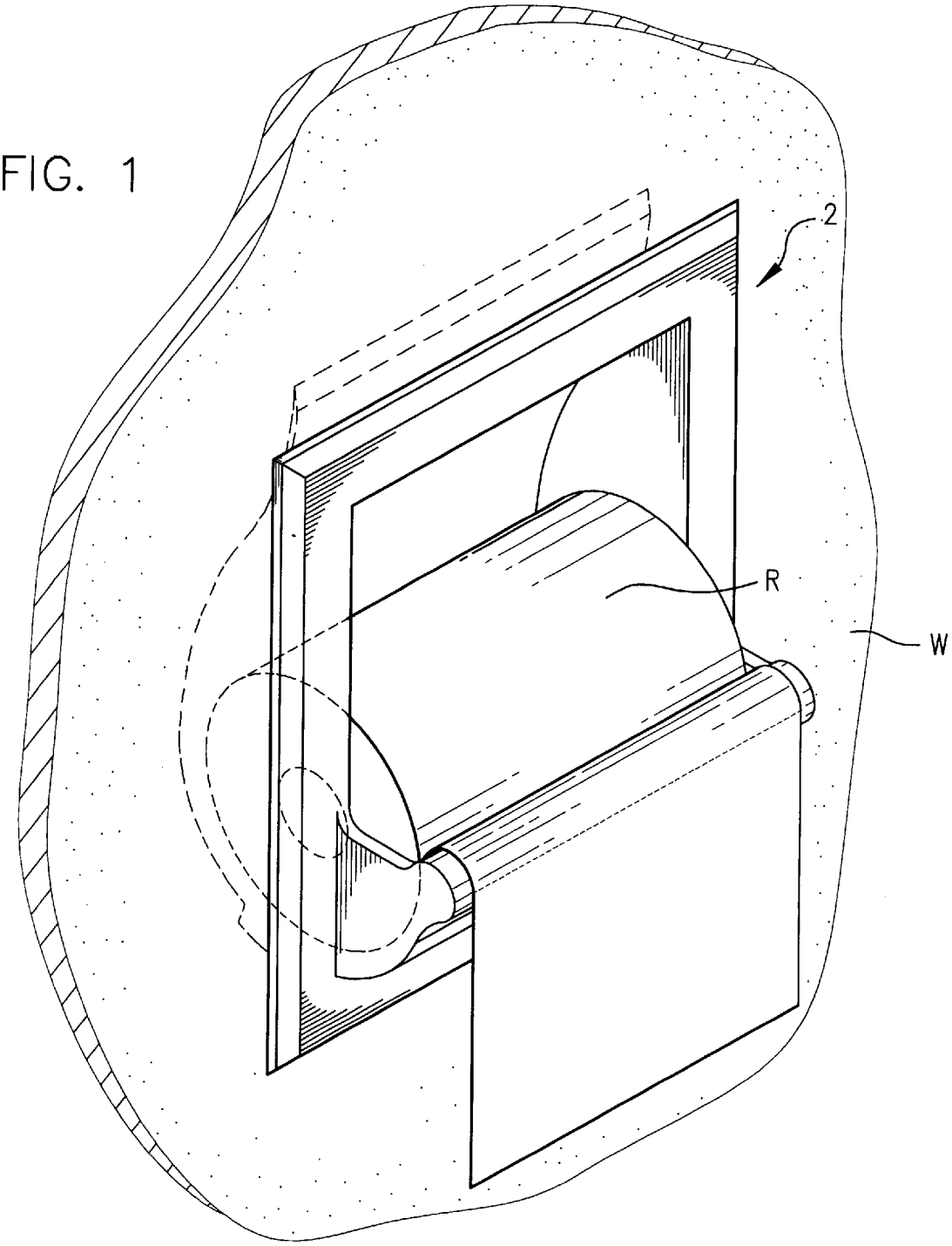
FIG. 1 is a perspective view of an embodiment of the toilet paper holder of the present invention with a roll of toilet paper therein mounted in a wall section.
Figure 2:
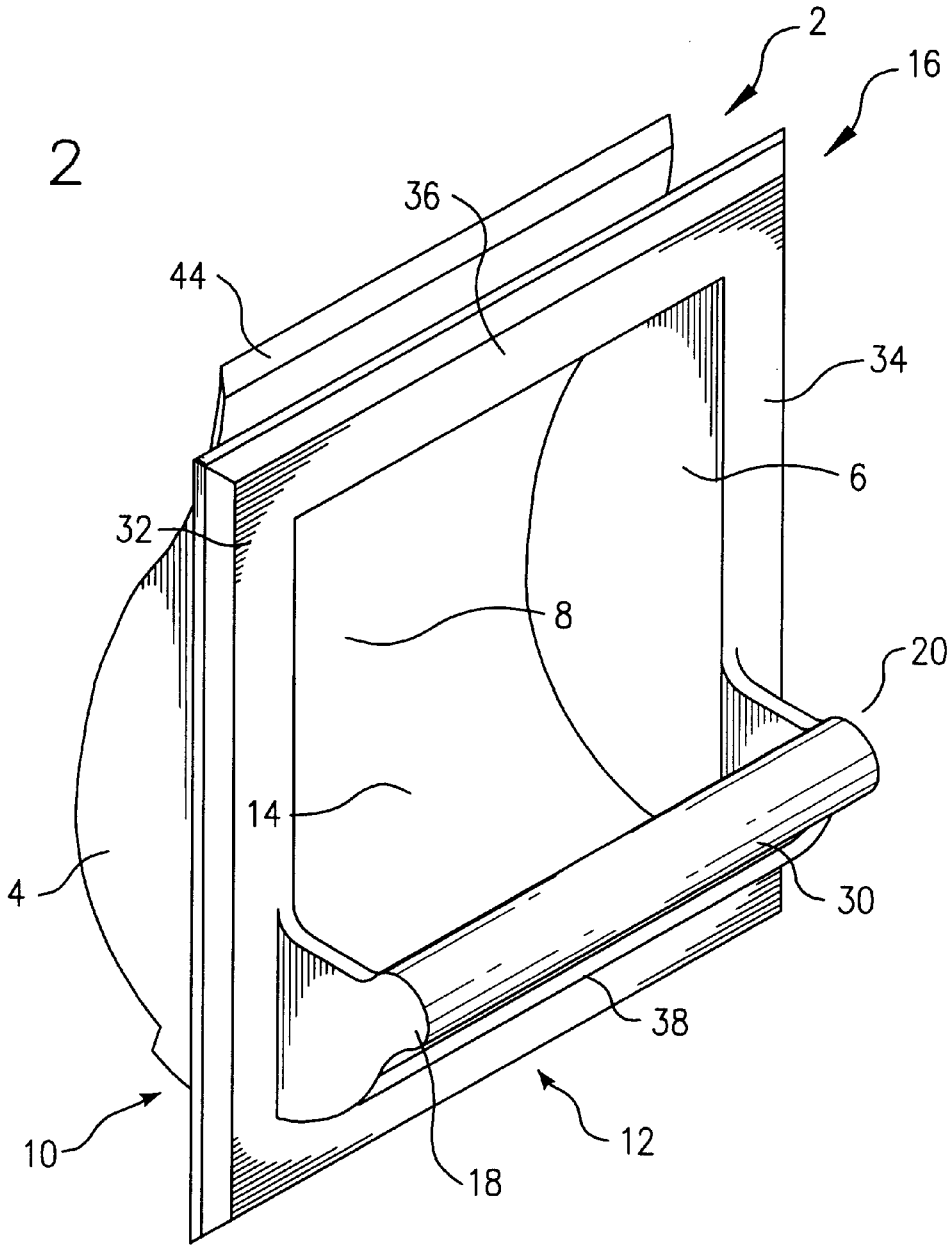
FIG. 2 is a perspective view of an embodiment of the toilet paper holder of the present invention.

Referring to FIGS. 1 and 2, paper roll holder 2 mounted in wall W is used to hold perforated toilet paper R or other rolled paper products, such as, for example, paper towels. Paper roll holder 2 includes end wall 4 and an opposite end wall 6, back wall 8, bottom 10, and front wall 12 which together form cavity 14 for holding paper roll R. End wall 4 and end wall 6 are preferably substantially planar with near ends abutting back wall 8 curved to conform to the half-ovoid shape of back wall 8. Back wall 8 is in the shape of a half-ovoid (half egg divided end to end), as seen more clearly in FIGS. 3 and 4. Bottom 10 and front wall 12 are coextensive, with bottom 10 extending upward from back wall 8 to front wall 12 thereby forming a cavity 14 between back wall, bottom and front wall to receive paper roll R. Frame 16 bounds cavity 14 and is adjoined to the forward edges of end wall 4, end wall 6, rear wall 8 and bottom 10. Front wall 12 protrudes forward and outwardly from frame 16 and has enclosing side walls 18 and 20 on either end. The outer edge of front wall 12 terminates in a rounded contact surface or lip 30, extending the length of the outer edge.

Surface 30 provides a surface for supporting and separating perforated sheets from paper roll R as the operator imparts a downward pulling force to perforated sheets of paper roll R, thus causing paper roll R to be braced against front wall 12 upon separation of sheets of paper from paper roll R at the location of contact surface 30.

Cavity 14 is of such a depth that a substantially horizontal plane P taken at contact surface 30 of front wall 12 will intersect the longitudinal axis A of paper roll R, when paper roll R is located in cavity 14 of paper roll holder 2. The above-stated depth of cavity 14 and height and extension of front wall 12 ensures that paper roll R will remain within cavity 14 upon application of downward force by the operator on perforated sheets supported by contact surface 30 to cause paper roll R to be braced by front wall 12 for separation of sheets of paper from paper roll R at contact surface 30 of front wall 12. In addition, the half-ovoid shape of the back wall 8 and the continuous curvature to bottom 8 and front wall lip 30 to form a cavity shaped in cross-section like the base of an egg, is important to achieve this objective.

Frame 16 is more specifically described as being comprised of spaced apart vertical side lip 32 and side lip 34, which are substantially parallel with respect to each other, and horizontal spaced apart top lip 36 and bottom lip 38, which are substantially parallel with respect to each other and are substantially perpendicular to side lip 32 and side lip 34. Side lip 32, side lip 34, top lip 36 and bottom lip 38 have an outside perimeter that is preferably larger than the wall opening in which paper roll holder 2 is to be secured.

Preferably the entire holder is made in one piece of plastic or cast (molded) material. Thus, it may be made of molded plastic, including the frame, in one integral piece.

Referring to FIGS. 3, 4, 5, and 6, the attachment of paper roll holder 2 to wall W is shown in sequence. The opening in wall W has an upper edge 40 and a lower edge 42. Upper clip wall 44, which is preferably a somewhat flexible, resilient planar member, extends upward the exterior surface of rear wall 8, and extends laterally across the width of rear wall 8. Upper clip wall 44 is preferably angled from vertical and is in spaced relationship from top lip 36 to form a channel 46 between upper clip wall 44 and top lip 36 of frame 16. Most preferably, upper clip wall 44 has a height greater than that of top lip 36 of frame 16 in order to facilitate attachment of paper roll holder 2 to wall W. Lower clip wall 48 extends outward from the exterior surface of bottom 10, laterally spanning the width thereof, and is in spaced relationship with respect to bottom lip 38 of frame 16 to form bottom channel 50.

Figure 3:
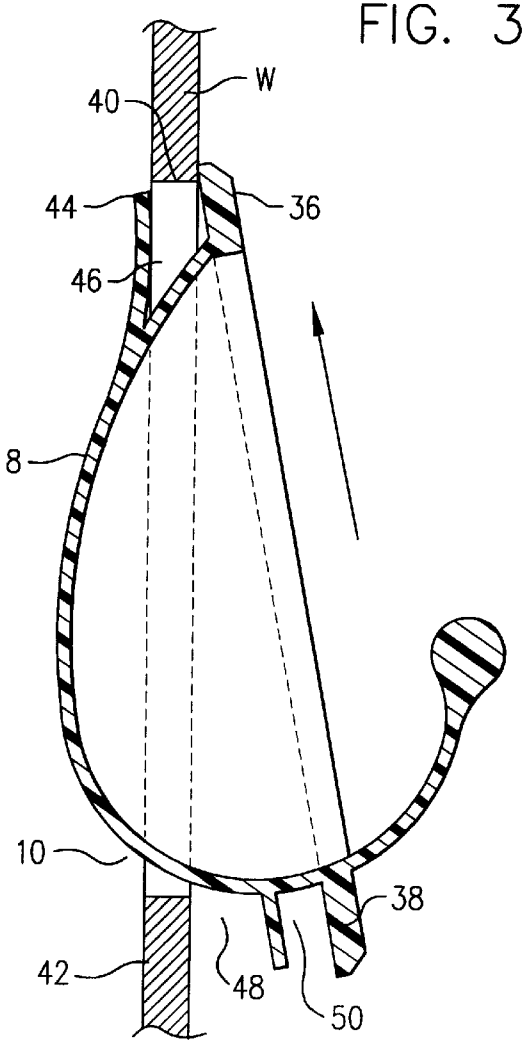
FIG. 3 is a view of an embodiment of the toilet paper holder of the present invention showing the first step in the sequence of attaching the toilet paper holder to a wall.

Referring specifically to FIG. 3, upper edge 40 of the opening of wall W is first placed between clip wall 44 and top lip 36 of frame 16, and in channel 46, by orienting frame 16 at an angle from vertical and imparting a force substantially parallel with the plane of frame 16 to paper roll holder 2.

Figure 4:
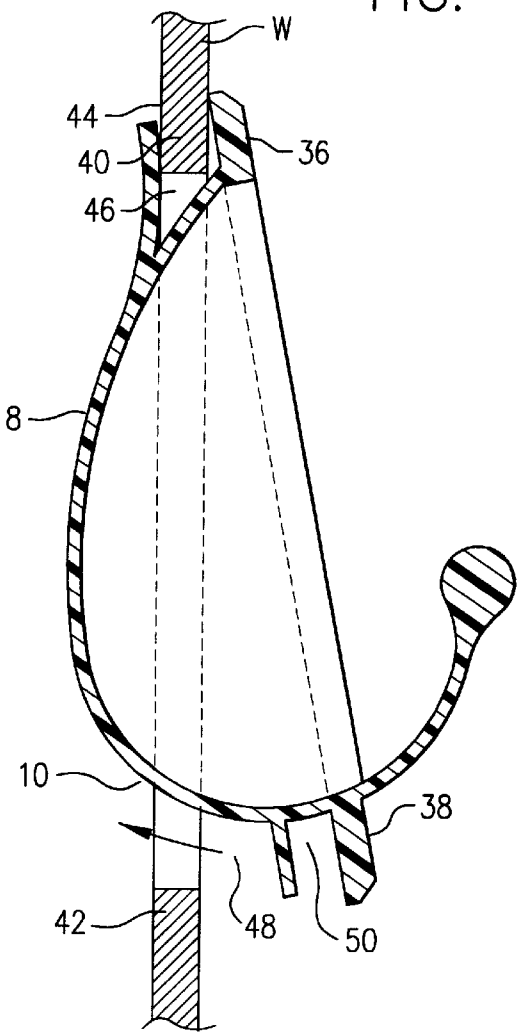
FIG. 4 is a side view of the toilet paper holder of FIG. 3 showing the second step in the sequence of attaching the toilet paper holder to a wall.

Referring to FIG. 4, paper roll holder 2 is pivoted around channel 46 which contains upper edge 40 of the opening of wall W, with upper clip wall 44 preferably providing resilient support against upper edge 40 to cause frame 16 to attain a substantially vertical orientation.

Figure 5:
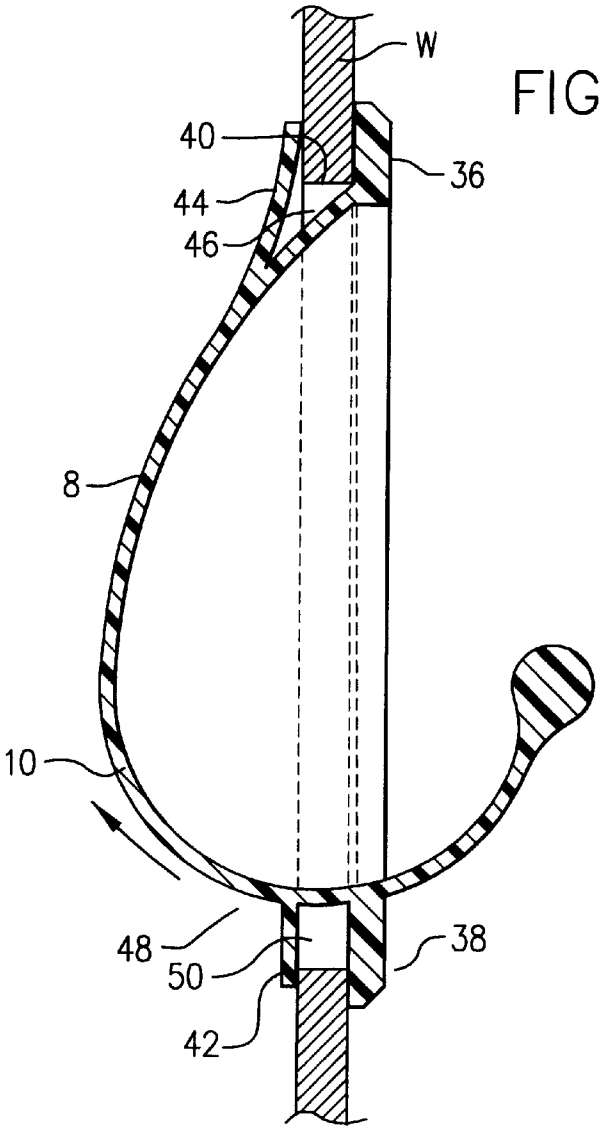
FIG. 5 is a side view of the toilet paper holder of FIGS. 3 and 4 showing the third step in the sequence of attaching the toilet paper holder to a wall.

As shown in FIG. 5, member 48 next passes by lower edge 42 of the opening wall W and through the opening in wall W as frame 16 attains a substantially vertical orientation.

Figure 6:
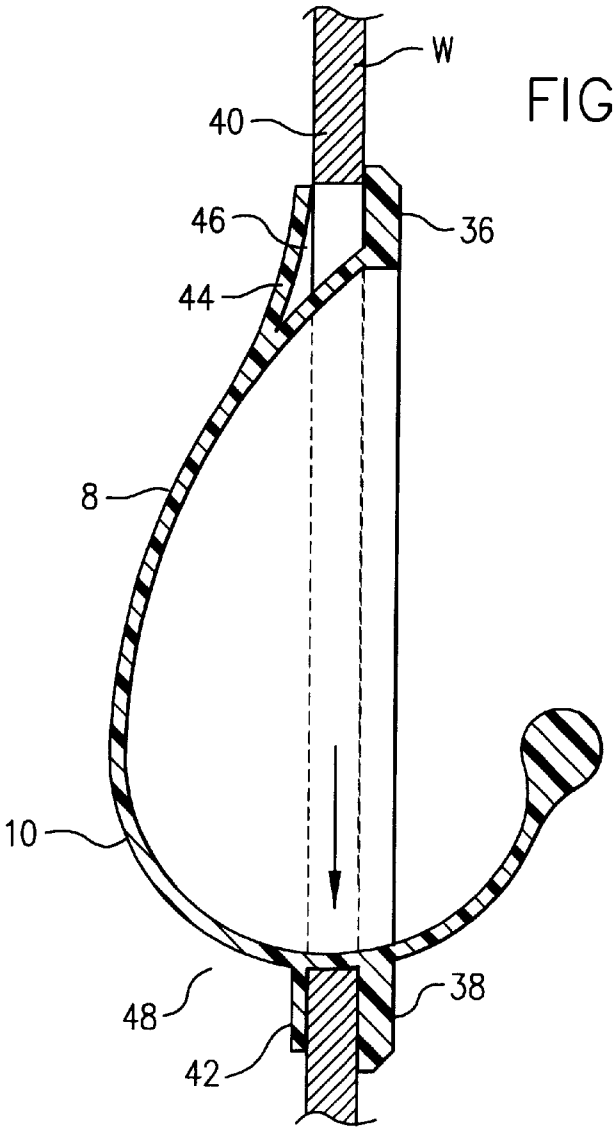
FIG. 6 is a side view of the toilet paper holder of FIGS. 3–5 showing the fourth step in the sequence of attaching the toilet paper holder to a wall.

Now referring to FIG. 6, a downward, substantially vertical force is applied to paper holder 2 in order to secure lower edge 42 of the opening in wall W between lower clip wall 48 and bottom lip 38 of frame 16, and in bottom channel 50, while maintaining attachment of upper edge 40 of the opening in wall W between upper clip wall 44 and top lip 36 of frame 16, and in channel 46. In order to conveniently remove the paper roll holder 2 from the opening in wall W, the above procedure is reversed.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A spindle-free toilet roll holder for attachment, without need for fasteners, into a wall having a specified thickness, the holder comprising:

(a) a back wall in the shape of a half-ovoid with a wider portion of the half-ovoid at a base portion of the back wall;

(b) a front wall lacking any opening therein, the front wall of lower height than the back wall, the front wall formed by forwardly and upwardly extending the base portion of the back wall to terminate in a rounded upper lip;

(c) a pair of side walls, the side walls, back wall and front wall forming a cavity in a base portion of the toilet paper holder, the cavity having a cross-section substantially in the shape of a bottom portion of a hen's egg and sized for holding a roll of toilet paper, the cavity lacking a spindle for insertion into an axial cavity of a roll of toilet paper, the cavity accessible over the upper lip of the front wall for insertion into the holder of a roll of paper;

(d) means for mounting the toilet paper holder to a wall, the mounting means comprising:

(i) an integral vertical frame surrounding the toilet paper holder and extending beyond an outside surface of the base portion, and beyond an outside surface of the upper extremity of the back wall;

(ii) an upper clip wall extending laterally across the upper outside surface of the back wall, and angled toward an adjacent rear of the frame such that a slot approximating the thickness of the wall to which the holder is to be mounted is formed between the clip wall and the frame; and (iii) a lower clip wall extending laterally across the outside surface of the base portion, the lower outer clip wall angled toward an adjacent rear of the frame to form a slot therebetween sized to hold a thickness of a wall to which the paper holder is to be mounted;

whereby, the paper holder is mounted to an appropriately sized cavity in a dry wall by holding said holder at an angle from the vertical and inserting an upper edge of the dry wall into the space between the frame and the upper clip wall, rotating the holder to a vertical position, such that rear surfaces of the frame contact the wall, and urging the holder downward such that a lower edge of the dry wall is engaged between the frame and the lower clip wall.

2. The holder of claim 1, wherein the holder is formed in one piece of molded plastic.

3. A spindle-free toilet roll holder for attachment, without need for fasteners, into a wall having a specified thickness, the holder comprising:

(a) a back wall in the shape of a half-ovoid with a wider portion of the half-ovoid at a base portion of the back wall;

(b) a front wall lacking any opening therein, the front wall of lower height than the back wall, the front wall formed by forwardly and upwardly extending the base portion of the back wall in a continuous curve to terminate in a rounded upper lip;

(c) a pair of side walls, the side walls, back wall and front wall forming a cavity in a base portion of the holder, the cavity having a cross-section in the substantial shape of a base portion of a hen's egg and sized for holding a roll of toilet paper, the cavity lacking a spindle for insertion into an axial cavity upper roll of toilet paper, the cavity accessible over the upper lip of the front wall for insertion of a roll of toilet paper;

(d) means for mounting the toilet paper holder to a wall, the mounting means comprising:

(i) a vertical frame surrounding the toilet paper holder such that a frontal face of the frame forms the upper frontal edges of the side walls and extends downward around outside surfaces of the base portion of the toilet paper holder, outer edges of the frame extending beyond the outside surfaces of at least the back wall and base portion;

(ii) an upper outer clip wall, the clip wall extending upward from and laterally across an upper outer surface of the back wall, the clip wall angled toward an adjacent rear surface of the frame to form a slot therebetween sized for holding onto a wall of specified thickness; and (iii) a lower outer clip wall, the lower clip wall extending downward from and laterally across an outer surface of the base portion of the toilet paper holder, the lower clip wall angled toward an adjacent rear surface of the frame to form a slot therebetween sized to hold a specified thickness of a wall to which the toilet paper holder is to be affixed;

whereby, when a roll of toilet paper having perforated sheets is inserted into the cavity, it is able to rotate freely in the cavity as paper is withdrawn from the roll, and sheets of paper may be separated at perforations from the roll in the vicinity of the upper lip of the front wall by pulling on the sheets, without pulling the roll out of the cavity.

4. The holder of claim 3, wherein the holder is formed in one piece of molded plastic.

* * * * *